US009525258B2

(12) United States Patent
Berard

(10) Patent No.: US 9,525,258 B2
(45) Date of Patent: Dec. 20, 2016

(54) CONTACT BRUSH

(75) Inventor: Geoffroy Berard, Amiens (FR)

(73) Assignee: MERSEN FRANCE AMIENS SAS, Amiens (FR)

( * ) Notice: Subject to any disclaimer, the term of this patent is extended or adjusted under 35 U.S.C. 154(b) by 389 days.

(21) Appl. No.: 13/985,131

(22) PCT Filed: Feb. 27, 2012

(86) PCT No.: PCT/FR2012/050400

§ 371 (c)(1),
(2), (4) Date: Sep. 19, 2013

(87) PCT Pub. No.: WO2012/117190

PCT Pub. Date: Sep. 7, 2012

(65) Prior Publication Data

US 2014/0001916 A1 Jan. 2, 2014

(30) Foreign Application Priority Data

Feb. 28, 2011 (FR) ..... 11 51594

(51) Int. Cl.

| | |
|---|---|
| ***H01R 39/20*** | (2006.01) |
| ***H01R 43/12*** | (2006.01) |
| ***H01R 39/64*** | (2006.01) |
| *H01R 39/26* | (2006.01) |

(52) U.S. Cl.

CPC ..... *H01R 39/20* (2013.01); *H01R 39/64* (2013.01); *H01R 43/12* (2013.01); *H01R 39/26* (2013.01); *Y10T 29/49119* (2015.01)

(58) Field of Classification Search

CPC ..... H01R 39/20; H01R 43/12; H01R 39/64
USPC ..... 310/219–252
See application file for complete search history.

(56) References Cited

U.S. PATENT DOCUMENTS

| | | | | |
|---|---|---|---|---|
| 3,274,304 | A | 9/1966 | Horton et al. | |
| 4,136,813 | A * | 1/1979 | Smith | B23K 1/19 228/224 |
| 4,358,319 | A * | 11/1982 | Yoshida | H01R 43/08 29/597 |
| 4,443,726 | A * | 4/1984 | Ikegami | H01R 39/24 310/239 |
| 2001/0024735 | A1* | 9/2001 | Kuhlmann-Wilsdorf | H01R 39/22 428/611 |
| 2005/0212376 | A1 | 9/2005 | Niimi et al. | |
| 2009/0261687 | A1 | 10/2009 | Lippert et al. | |
| 2010/0007237 | A1* | 1/2010 | Nies | H01R 39/646 310/232 |
| 2010/0133951 | A1 | 6/2010 | Neuweger et al. | |

FOREIGN PATENT DOCUMENTS

| | | | | |
|---|---|---|---|---|
| EP | 1 713 148 | A1 | 10/2006 | |
| FR | 2003341 | A1 | 11/1969 | |
| FR | 2 709 611 | A1 | 3/1995 | |
| GB | 1191234 | A | 5/1970 | |
| GB | 2 247 232 | A | 2/1992 | |
| GB | 2443808 | A * | 5/2008 | B22F 3/24 |

(Continued)

*Primary Examiner* — Naishadh Desai
(74) *Attorney, Agent, or Firm* — Sughrue Mion, PLLC

(57) ABSTRACT

A brush intended for ensuring electrical contact between a fixed part and a moving part, said brush comprising a layer composed chiefly of carbon, silver, and of another metal different from silver, for example copper.

13 Claims, 1 Drawing Sheet

(A) (B)

(56) References Cited

FOREIGN PATENT DOCUMENTS

| | | | |
|---|---|---|---|
| JP | 61-121744 | A | 6/1986 |
| JP | 5-277762 | A | 10/1993 |
| JP | 10-023717 | A | 1/1998 |
| JP | 2000-197315 | A | 7/2000 |

* cited by examiner

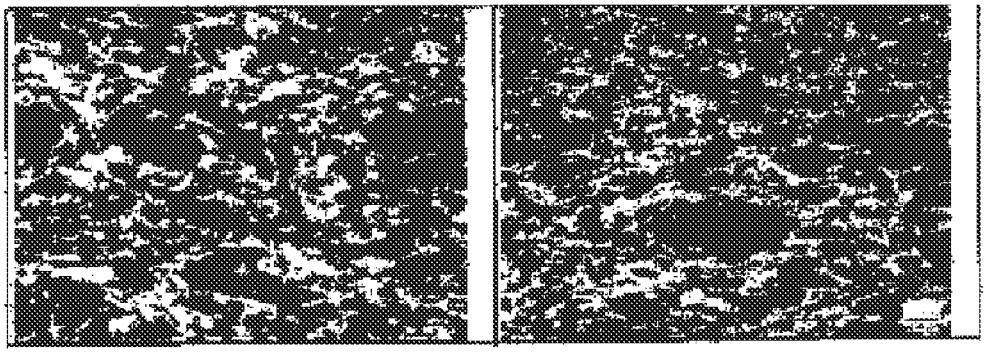
(A) (B)

CONTACT BRUSH

CROSS REFERENCE TO RELATED APPLICATIONS

This application is a National Stage of International Application No. PCT/FR2012/050400 filed Feb. 27, 2012, claiming priority based on French Patent Application No. 11 51594 filed Feb. 28, 2011, the contents of all of which are incorporated herein by reference in their entirety.

The invention relates to the field of brushes intended to ensure an electrical contact between a stationary part/element and a rotating part/element in a rotary electric machine. The rotary part may for example be a collecting part of an electric motor or a ring of a wind turbine.

These brushes are generally made of graphite. It is known, especially in applications involving large currents, or precise signals, to manufacture brushes from a mixture of graphite and silver powders.

The silver makes it possible to provide sliding electrical contacts having a relatively low voltage drop across the contact with the rotary part, and a low electrical resistivity, thereby improving heat dissipation. Furthermore, in operation silver oxides form, which have the property of being good electrical conductors (in comparison with other metal oxides). Because of these properties, these devices enabling a sliding electrical contact, such as brushes, are advantageously employed in fields, in particular the aeronautic and wind-turbine fields, in which extreme operating conditions (corrosive, hot or humid atmospheres or partial vacuums) are encountered. Thus, usually care is taken to ensure that the silver component of these devices is free from metal impurities that could degrade the quality and performance thereof via an undesirable oxidation or via degraded electrical properties. However, it is well known that electrical contact devices, in particular brushes, containing a metal other than silver, such as copper, are used for different purposes than those of silver-based brushes.

Nevertheless, silver is a relatively expensive raw material that is not readily available on the market. In addition, it has been demonstrated that the properties of the brush are relatively strongly dependent on the quality of the silver powder used.

There is therefore a need for a sliding electrical contact device, such as a brush, that is less expensive and that has a better reproducibility.

Therefore, a brush intended to ensure electrical contact between a stationary part and a moving part is provided, this brush comprising a layer mainly made of carbon, silver and another metal different from silver.

The term "carbon" is understood to mean any compound containing the element carbon, graphite advantageously being used as graphite is a "carbon" that has both electrical and frictional properties appropriate for sliding electrical contacts.

Thus, this brush is less expensive than prior-art brushes, and the source of the silver is less of a determinant of the properties of the brush than in the prior art where, in the case of difficulty sourcing silver from a given supplier, there was a risk, if another supplier was chosen, of the brush properties being irreproducible.

Advantageously, the other metal, i.e. the metal other than silver, is able to partially substitute for the latter while, on the one hand, not adversely affecting the physical properties of the constituent materials of the brush, which properties determine the operational performance of the brushes, and on the other hand, limiting the cost of the final brush device.

In particular, the electrical and mechanical properties of the brush depend on the nature of the other metal, on the sintering temperature used during manufacture of the brushes, and/or on the relative weight proportions of silver/other metal, whether these metals are alloyed or indeed unalloyed. For example, certain metals either oxidize unacceptably or do not have the desired electrical resistivity properties. In other words, the other metal is chosen so that the brush has at least the same electrical and mechanical properties as a brush mainly made of silver and carbon.

In advantageous embodiments of the invention, the other metal is chosen from the group made up of conductive metals having electrical resistivities typically between 1.7 and $700\times10^{-8}$ ohm·m at 20° C.

Very advantageously, and nonlimitingly, this other metal may be chosen from aluminum, zinc, iron, nickel, steel, tin and copper.

In particular, this other metal may be copper. Preliminary experiments carried out by the Applicant on the silver/copper mixture have indeed shown that this mixture allows the mechanical and electrical properties of the brush to be preserved or even improved. Furthermore, the use of silver and copper in a brush led to a greater respect of the surface finish of the rotary part, in comparison with silver alone.

Very advantageously, the silver and the other metal are not alloyed.

Under these conditions, analysis of the microstructure of the materials obtained from a carbon/silver/copper mixture has made it possible to confirm that, during manufacture of the material in these preferred embodiments, the copper does not alloy with the silver. The explanation for this is that the sintering temperature used is below that of the eutectic silver/copper system (779° C.). The lack of alloying makes it possible to take advantage of the most advantageous properties of each of the metals. For example, silver is recognized as being more ductile than copper but copper has a greater tenacity than silver.

Furthermore, analysis of the microstructure has shown that the material obtained by partial substitution of silver with copper has a particularly fine and interconnected metal lattice, relative to the material formed with silver metal alone, in other words enabling a better percolation through the constituent materials of the brush, advantageous for the passage of electrical current.

The explanation for this difference lies in the initial properties of the silver and copper grains, in their high respective ductilities and the particular chemical affinity of these two metals. The morphology, the size, the density and the ductility of the grains are a result of both the chemical nature of the constituent materials and the method used to obtain them. These aspects define the working properties of the mixtures i.e. their behavior during pouring, filling, rearrangement, compression and compaction. This behavior considerably influences the densification of said material in the compression phase. Moreover, for ductile materials, the final properties of said device after the sintering step depend on this densification.

Advantageously, and on the basis of the preceding observations based on silver/copper mixtures, the Applicant selected certain of the aforementioned parameters, such as the chemical nature, the tamped density, the particle size distribution, and the specific surface area of each powder, in order to produce a material, comprising silver and the other material, exhibiting an optimal degree of densification during the compression phase. This allows a material to be obtained, after sintering, having mechanical and electrical performances similar to or even better than those of materials in which the metal is only silver, due to the specific nature of the microstructure obtained. This selection is in particular carried out based on the properties of the various powders.

In other embodiments, the silver and the other metal are alloyed provided that the aforementioned desired effects are obtained.

Advantageously, the brush furthermore comprises at least one additional layer, thereby allowing the brush to be better adapted to various manufacturing and operating constraints.

For example, the additional layer may contain no silver, or indeed comprise silver in a relatively small amount, for example less than 5% by weight. Limiting the amount of silver in the brush in this way allows its price and dependence on the quality of the silver raw material to be decreased.

For example, the layer described above (containing carbon, silver and the other material) may be used as a wear layer that makes contact with a rotary part, the additional layer forming an anchoring or connecting layer enabling electrical connection to the stationary part. It is thus possible for the sliding contacts to benefit from properties conferred by the silver, especially a relatively small voltage drop across the contact. In this case, the additional layer is located above the wear layer, along a vertical axis, relative to the plane of contact between the brush/rotary part. The size of this layer will be chosen, by a person skilled in the art, with regard to the plane of the brush studied. In one embodiment, the brush may comprise more than two layers, for example three or more layers. Apart from a wear layer and a connecting layer, the brush may thus comprise a switching layer, a layer for running in a collector, etc. Advantageously one or more intermediate layers placed between the wear layer and the connecting layer allow a gradient to be established in the weight proportion of the other metal in the brush, this gradient being such that the weight proportion of the other metal increases from the wear layer to the connecting layer, in order to improve the mechanical cohesion of the brush.

The invention is not limited by the number of layers, nor by their arrangement.

In particular, the brush may consist of a single silver-containing layer such as described above.

The invention is not limited by the composition of the additional layer. This layer may, for example, be essentially made of metal, for example of copper.

Advantageously, the additional layer may be mainly made of carbon and of metal, advantageously the other metal. Using the same metal, i.e. the "other" metal, from one layer to another makes it possible to obtain relatively satisfactory mechanical and electrical qualities, but it is of course possible to use another metal in this additional layer.

Apart from the carbon and the metal, the layer may comprise at least one binder and/or at least one additive, in proportions conventionally used in the art, i.e. in proportions ranging from 1 to 20% by weight, the binder may typically be a phenolic resin and the additives may, in particular, typically be chosen from the families of solid lubricants, abrasives and anti-oxidizing additives usually used in the field of sliding electrical contacts. Advantageously, the additional layer may have a composition similar to the layer described above, in the sense that the weight proportions of metal and carbon may be relatively similar from one layer to the other. The proportion of metal in the additional layer may especially be substantially identical to the proportion of metal (i.e. the proportion of both the silver and the other metal) in the silver-containing layer described above.

Advantageously, in a brush comprising the additional layer and the wear layer that comprises silver and another metal, said layers furthermore comprise at least one binder and/or at least one additive, the carbon, said at least one binder and/or said at least one additive having identical natures and being present in substantially equal relative weight proportions from one layer to another. Thus, in these two layers the same binder(s) and the same additive(s) and, for example, the same graphite are used, and in proportions that are substantially equal from one layer to the other.

The expression "substantially identical" is understood to mean that the difference in the weight proportion of carbon from one layer to the other is less than 5%, and advantageously less than 2%, of the weight of carbon in the wear layer or anchoring layer. This is because this composition improves mechanical cohesion between the two layers after baking.

This allows a relatively good mechanical cohesion to be obtained between these two layers, making it possible to produce a brush that will have a relatively long lifetime. Without wishing to be bound by any one theory, this might lead the two layers having relatively similar thermal expansion coefficients, thereby limiting the generation of stresses at the interface between these two layers Within the silver-containing layer the relative weight proportions of silver and other metal are from 10/90 to 90/10, and advantageously from 20/80 to 80/20.

For example, the relative weight proportions of silver metal and other metal will preferably be 70/30 to 30/70. Advantageously, the relative weight proportions of silver metal and other metal will lie in the range of values extending from 40/60 to 60/40, preferably from 45/55 to 55/45, and will in particular be 50/50. In certain cases, the relative weight proportions of silver and other metal are 70/30, 50/50 or 30/70.

The expression "layer mainly made of such and such a component" is understood to mean that the weight of all of these such and/or such components represents more than 70% of the weight of the layer, advantageously more than 80% of the weight of the layer, and advantageously about 90% of the weight of the layer. The expression "about 90%" is understood to mean between the 85% and 95%, and advantageously between 88 and 92%.

The rest of the weight of the layer is made up of additives and/or binders. The weight proportion of the one or more additives may represent less than 10% of the weight of the layer, advantageously less than 5% of the weight of the layer, and advantageously more than 2% of the weight of the layer. The weight proportion of the one or more binders may represent less than 20% of the weight of the layer, advantageously less than 10% of the weight of the layer, and advantageously more than 4% of the weight of the layer.

Advantageously, each of these such or such components may be present in the layer in a proportion higher than 5 wt % relative to the weight of the layer, advantageously in a proportion higher than 10 wt % relative to the weight of the layer, advantageously in a proportion higher than 15 wt % relative to the weight of the layer, advantageously in a proportion higher than 20 wt % relative to the weight of the layer, and advantageously in a proportion lower than 80 wt % relative to the weight of the layer.

For example, the weight of the silver/copper/carbon assembly may represent 90% of the weight of the wear layer, and the weight of the copper alone may represent between 20% and 40% of the weight of the wear layer. For example, the weight of the copper/graphite assembly may represent 90% of the weight of the anchoring layer.

Among the advantages of brushes produced according to the invention, mention may be made of the following.

Under similar manufacturing conditions and identical test conditions it was observed that a brush made of silver/carbon, comprising 65% by weight silver, as is conventionally the case, exhibited a wear rate and a coefficient of friction substantially identical to those of a brush based on carbon/silver/another metal, the other metal in particular being copper.

The Applicant has also observed a better respect of the surface finish of the rotary part, in particular less deformation (out-of-round). Without wishing to be bound by any one theory, the Applicant assumes that the particular microstructure obtained with the material containing silver and the other metal, i.e. in particular copper, could at least partially explain this result.

Furthermore, an increase in the temperature of the rotary part was not observed when the brush according to the invention was used, this temperature remaining in the 70° C. to 90° C. range depending on the relative weight proportions used. This observation could appear surprising, because, given that silver is a better electrical conductor than the other metal according to the invention, substituting silver with this other metal could have led to an increase in the temperature via Joule heating. However, on the one hand, it was observed that the electrical properties of the brush were maintained, and on the other hand, it was observed that the metal lattice exhibited a better percolation.

Thus total (electrical and mechanical) losses remained the same.

A process for manufacturing a brush according to the invention is also provided, this process comprising a step of mixing a carbon powder, in particular a graphite powder, with a metal powder, this metal powder being mainly made of silver and another metal different from silver. This metal powder may, for example, itself have been obtained by mixing a silver powder and a powder of this other metal.

According to some embodiments, the powders are then compressed, optionally in an appropriate mould having the shape of the desired brush, then the green, i.e. unsintered, material obtained is sintered at a temperature below that of the eutectic silver/other metal system, thereby producing an unalloyed material.

The powders of the various constituents are made up of particles of similar sizes usually chosen by those skilled in the art with a view to obtaining the physical properties desired for the final material.

This process may allow a brush such as described above to be obtained.

Furthermore, it is proposed to use the brush obtained in an electric machine used to transfer power, which machine is in particular a generator such as a wind turbine.

Moreover, the invention relates to the use of the brush according to the invention in an application characterized by electrical currents lying between 1 and 1000 mA, and by voltage drops across the contact of between 1 and 1000 mV, typically a signal transfer application.

The invention is not limited to a given application; however, mention may especially be made of:

- applications relating to the transfer of electrical power, for example in the fields of wind turbines, special machines, etc.;
- applications relating to signal transfer, for example in the fields of tachometers, of the sensing of measurement currents such as with thermocouples and thermometer probes, in small precision motors for timepieces, medical applications, etc.; and
- applications in very dry atmospheres, for example in the aeronautic or aerospace field.

The invention is described in greater detail with reference to an embodiment, described below with reference to FIG. 1, which shows example brush wear-layer microstructures, (A) according to the prior art and comprising 65% silver, and graphite, and (B) according to the invention with a relative Ag/Cu weight proportion of 50/50, also containing graphite.

In this embodiment, a brush comprising two layers, i.e. a bilayer brush, comprises:

- a silver-containing layer called the wear layer, functional layer or else contact layer; and
- an additional layer, also called the connecting or anchoring layer.

The wear layer mainly comprises carbon, in the form of graphite, silver, and copper.

The weight of the silver present in the wear layer represents about 32% of the weight of the wear layer.

The weight of copper present in the wear layer represents about 32% of the weight of the wear layer.

The remaining weight, namely 36% of the weight of the wear layer, is mainly made up of graphite and furthermore comprises one or more binders, and additives, in proportions that are conventional in the art. Here a phenolic resin is chosen by way of a binder. For example, graphite is present in a proportion of 26 wt % relative to the weight of the wear layer, the one or more additives in a proportion of 3.5 wt %, and the phenolic resin in a proportion of 6.5 wt %.

The connecting layer mainly comprises graphite and copper.

The weight of the copper present in the anchoring layer represents about 64% of the weight of the anchoring layer.

The remaining weight namely 36% of the weight of the anchoring layer, is mainly made up of graphite and may also comprise one or more binders and additives, of the types and in proportions that are conventional in the art. For example, graphite is present in a proportion of 26 wt % relative to the weight of the connecting layer, the one or more additives in a proportion of 3.5 wt %, and the phenolic resin in a proportion of 6.5 wt %.

The graphite, the binders and additives are the same in both layers. For example, each of these materials may be sourced from the same supplier.

As may be seen, the weight proportion of copper in the connecting layer is substantially identical to the weight proportion of metal (i.e. here silver and copper) in the wear layer. Thus, in this example, both layers contain 64% by weight metal.

In other words, the weight proportion of the graphite added to that of the binder(s) and additive(s) is substantially identical in the connecting layer and in the wear layer.

The expression "substantially identical" is understood to mean that the difference in the weight of carbon from one layer to the other is less than 5%, and advantageously less than 2%, of the weight of carbon in the wear layer or anchoring layer. This is because this composition improves mechanical cohesion between the two layers after baking.

The anchoring layer or connecting layer is not intended to make contact with the rotary part during the lifetime of the brush. Its function is to house cables or other electrical connection elements and to provide electrical and mechanical properties that are required for correct operation of the brush. There is therefore no need for this connecting layer to comprise silver in its composition. This layer is therefore mainly made of graphite and copper. This connecting layer has the same metal content and the same carbon content as the wear layer, which layer is also called the functional layer or contact layer.

In this embodiment, the silver and copper are present in the wear layer in relative weight proportions of 50/50. As a variant, the ratio of the relative proportion of silver to the relative proportion of copper in this wear layer may be 70/30.

As another variant, the ratio of the relative proportion of silver to the relative proportion of copper in this wear layer may be 30/70.

Relative weight proportions of 50/50 are particularly advantageous in that they allow the cost of the brush to be reduced by 68% relative to a prior-art brush mainly made of graphite and silver. When the relative weight proportions of silver and copper are 70/30, the cost reduction relative to the prior art is about 30%.

In this embodiment, it has been chosen to use copper. This metal is advantageous because it is relatively conductive. Nevertheless, it may be envisioned to choose another metal, in particular aluminum, iron, tin, steel, or zinc, since this may prove to be advantageous from the cost point of view.

A process for manufacturing this brush, in accordance with a preferred embodiment of the invention, is now briefly described.

To obtain the wear layer the phenolic resin may, in a first step, be for example mixed with graphite. The phenolic resin then coats the graphite particles. In a second step, the graphite coated in this way is ground and sieved in order to obtain a particle size distribution that is conventional in the art. Lastly, this premix is uniformly mixed with silver powder, copper powder and the one or more additives.

To produce the connecting layer, the same premix may also be mixed with copper powder.

The bilayer brush may then be produced using a process such as described in document FR 2 709 611. For example, the mixture mainly made of copper and graphite, on the one hand, and the mixture mainly made of copper, silver and graphite, on the other hand, are fed into a mould from a partitioned hopper via a movable piston-type base. The powders in the mould are then compressed by an upper piston using a compressing force that allows the desired density to be obtained; the material obtained is then sintered at a temperature between 200 and 779° C. A brush in which the metals are not alloyed is thus obtained.

The Applicant has carried out trials on a rotary electric machine with brushes comprising a wear layer with:

sample A: 70/30 (relative weight proportion Ag/Cu);
sample B: 60/40 (Ag/Cu);
sample C: 50/50 (Ag/Cu);
sample D: 30/70 (Ag/Cu); and
comparative sample: 100/0 (Ag/Cu).

The trial conditions were as follows.

The rotary part consisted of a 200 mm-diameter collecting ring made of bronze having an appropriate width relative to the sizes of the brushes, in this specific case 27 mm, and rotating at a peripheral speed of 20 m/s.

Three identical brushes made contact with the ring, these brushes having dimensions t×a×r, "t", "a" and "r" being defined according to the nomenclature of the (Swiss) "*Commission Electrotechnique Internationale*", of 20×10×32 mm. Pressure of 380 g/cm$^2$ was exerted on the brushes and the current density was 15 A/cm$^2$. The ambient temperature of the assembly was kept fixed at 55° C. throughout the trial by virtue of an appropriate device. The aforementioned parameters were used as they are all typical of the intended application.

Table 1 shows the results obtained.

TABLE 1

| Sample | Relative weight proportion Ag/Cu | Weight percentage* | Wear rate (mm/1000 h) | Temperature (T° C.) |
|---|---|---|---|---|
| Comparative | 100/0 | 65% Ag/0% Cu | 2.6 | 81 |
| A | 70/30 | 45% Ag/20% Cu | 2.6 | 76 |
| B | 60/40 | 39% Ag/26% Cu | 2.1 | 83 |
| C | 50/50 | 32% Ag/32% Cu | 1.2 | 91 |
| D | 30/ | 20% Ag/45% Cu | 1.7 | 77 |

*N.B. these weight percentages have in certain cases been approximated.

Table 1 shows that the brushes of the invention not only exhibit a comparable wear rate to that obtained with conventional brushes, but that this wear rate may be smaller by a factor of 2.

Surprisingly, the surface temperature of the ring is substantially identical from one sample to the other, the measured values conforming with the suggested values recommended by those skilled in the art, i.e. a range of between 60 and 100° C., for forming a third body, called a patina, necessary for optimal tribological operation of the brush/ring assembly.

The invention claimed is:

1. A brush intended to ensure electrical contact between a stationary part and a moving part, said brush comprising a layer mainly made of carbon, silver and another metal different from silver, wherein said layer is obtained by mixing a carbon powder and a metal powder, said metal powder being mainly made of silver and of said another metal different from silver, compressing the mixed powders so as to obtain a green material, and sintering the obtained green material at a temperature below that of the eutectic silver/other metal system.

2. The brush as claimed in claim 1, in which the other metal is chosen so that the brush has at least the same electrical and mechanical properties as a brush mainly made of silver and carbon.

3. The brush as claimed in claim 1, in which the other metal is chosen from the group consisting of conductive metals having electrical resistivities between 1.7 and 700×$10^{-8}$ ohm·m at 20° C.

4. The brush as claimed in claim 1, in which the other metal is chosen from aluminum, zinc, iron, nickel, steel, tin and copper.

5. The brush as claimed in claim 1, in which the silver and the other metal are not alloyed.

6. The brush as claimed in claim 1, in which the relative weight proportions of silver metal and other metal lie in the range of values extending from 30/70 to 70/30.

7. The brush as claimed in claim 1, furthermore comprising at least one additional layer.

8. The brush as claimed in claim 7, in which the additional layer contains no silver.

9. The brush as claimed in claim 7, in which the additional layer is mainly made of carbon and metal.

10. The brush as claimed in claim 9, in which the additional layer and the wear layer comprising silver and the other metal furthermore comprise at least one binder and/or at least one additive, characterized in that the carbon, said at least one binder and/or said at least one additive have identical natures and are present in substantially equal relative weight proportions from one layer to the other.

11. The use of the brush as claimed in claim 1 in an electric machine for transferring power, which machine is in particular a generator.

12. The use of the brush as claimed in claim 1 in an application characterized by electrical currents of between 1 and 1000 mA, and by voltage drops across the contact of between 1 and 1000 mV, typically a signal transfer application.

13. The brush as claimed in claim 6, in which the relative weight proportions of silver metal and other metal lie in the range of values extending from 40/60 to 60/40.

* * * * *